US010273736B2

(12) United States Patent
Hucker

(10) Patent No.: US 10,273,736 B2
(45) Date of Patent: Apr. 30, 2019

(54) BRAKING MECHANISM FOR A MOVABLE ARM OF A MOVABLE DOOR WING AND CORRESPONDING DOOR

(71) Applicant: GEZE GmbH, Leonberg (DE)

(72) Inventor: Matthias Hucker, Merxzell (DE)

(73) Assignee: Geze GmbH, Leonberg (DE)

( * ) Notice: Subject to any disclaimer, the term of this patent is extended or adjusted under 35 U.S.C. 154(b) by 0 days.

(21) Appl. No.: 15/622,291

(22) Filed: Jun. 14, 2017

(65) Prior Publication Data

US 2017/0362873 A1 Dec. 21, 2017

(30) Foreign Application Priority Data

Jun. 16, 2016 (DE) ..... 10 2016 210 780

(51) Int. Cl.

| | |
|---|---|
| ***E05F 15/00*** | (2015.01) |
| ***E05F 15/603*** | (2015.01) |
| ***E05F 5/00*** | (2017.01) |
| ***E05F 5/08*** | (2006.01) |

(52) U.S. Cl.

CPC ..... *E05F 15/603* (2015.01); *E05F 5/00* (2013.01); *E05F 5/08* (2013.01); *E05Y 2400/302* (2013.01); *E05Y 2400/40* (2013.01); *E05Y 2900/132* (2013.01)

(58) Field of Classification Search

CPC ..... E05F 15/603; E05F 5/00; E05Y 2900/132
USPC ..... 49/138
See application file for complete search history.

(56) References Cited

U.S. PATENT DOCUMENTS

| | | | | |
|---|---|---|---|---|
| 6,177,771 | B1 * | 1/2001 | Kinzer | G05B 19/291 318/280 |
| 6,481,160 | B1 * | 11/2002 | Kowalczyk | E05F 3/224 49/333 |
| 6,634,140 | B1 * | 10/2003 | Sellman | E05F 15/41 49/340 |
| 8,547,046 | B2 * | 10/2013 | Burris | E05F 3/227 16/49 |
| 8,844,200 | B2 * | 9/2014 | Yulkowski | E05F 15/50 49/138 |
| 2010/0315229 | A1 * | 12/2010 | Shin | E05F 5/00 340/540 |

(Continued)

*Primary Examiner* — Jerry E Redman
(74) *Attorney, Agent, or Firm* — Steven M. Shape; Dennemeyer & Associates

(57) ABSTRACT

The invention relates to a braking mechanism (10) for a movable door wing (1) with an electric motor (14) operating as a generator, the at least one drive shaft of which can be rotated by a movement of the door wing (1), and at the terminals thereof, a movement-dependent output voltage is produced, which is applied to an evaluation and control unit (20), and a stop spring (12) which damps a manual opening movement of the door wing (1) between a predetermined opening angle and a maximum opening angle with a constant first damping, and a corresponding door with a braking mechanism of this type. In accordance with to the invention, the evaluation and control unit (20) performs a pulse width modulation (PWM) of the motor current cooperating with the output voltage and establishes an effective sequence of braking force, which generates a variable second damping of the opening movement of the door wing (1), so that the door wing (1), when released, stops upon reaching the maximum opening angle.

11 Claims, 3 Drawing Sheets

(56) References Cited

U.S. PATENT DOCUMENTS

Figure 1:
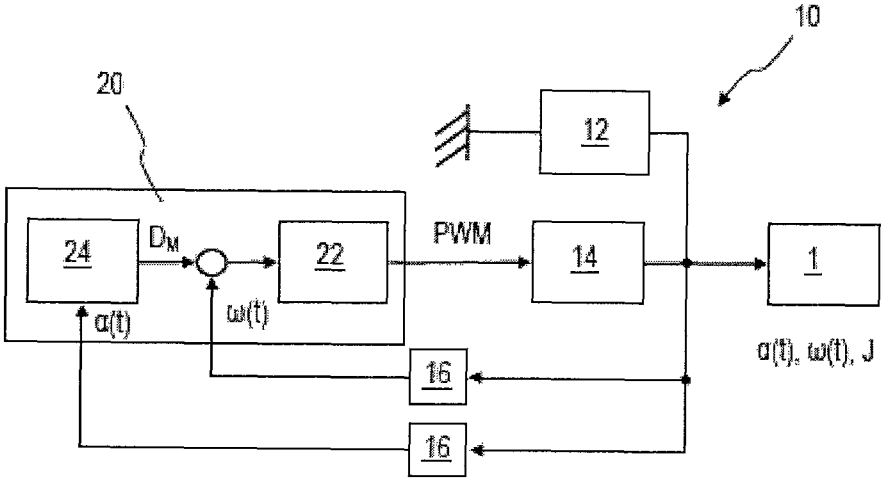

2012/0090242 A1* 4/2012 Bocquet ..... E06B 9/68
49/138

* cited by examiner

BRAKING MECHANISM FOR A MOVABLE ARM OF A MOVABLE DOOR WING AND CORRESPONDING DOOR

The invention relates to a braking mechanism for movable door wings of different types.

Braking mechanisms for movable door wings are known and widely used. During manual opening, the door wing is accelerated in the direction of opening and then released. Because of its inertia, after release, the door wing will be opened at least a small distance farther against the action of a stop spring. If the kinetic energy in the door wing is too low, it will not be sufficient to stretch the stop spring far enough for the door wing to reach its open position or a maximum opening angle. If the kinetic energy in the door wing has an optimum value, the stop spring will be stretched just far enough so that the door wing will remain standing in the open position with the maximum opening angle. If the value of the kinetic energy in the door wing is too high, the spring will be fully stretched and the door wing will bump in the open position. To avoid the bumping of the door wing in the open position, the principle of "opening damping" is known for hydraulic door closers; with this, for example, above a certain opening examples (e.g. 60°) a valve is closed, so that a smaller cross section is available for outflow of the hydraulic fluid and the door wing experiences greater damping above this opening angle.

The drawback of all known methods of "opening damping" is that this is constant or at best, velocity-dependent. To be sure, the risk of the door wing bumping in the open position is reduced, but the door wing also no longer opens completely. In addition, the opening damping can also be influenced by changes in the temperature of the hydraulic fluid and/or the frictional conditions. In addition, escaping hydraulic fluid can lead to environmental contamination if the door closer becomes leaky, and the hydraulic fluid must be disposed of. In addition, hydraulic fluid is generally combustible, which can contribute to the spread of fire if it escapes and ignites during a fire.

Furthermore, braking mechanisms for movable door wings that use electric motors operated as generators for damping are known from the prior art.

A drive for operating a movable door wing with a braking mechanism is known from DE 10 2005 028 007 B.Th. braking mechanism with which the movement of the door wing can be braked comprises an electric motor operated as a generator, the motor shaft of which is rotatable by a movement of the door wing and at the motor terminals of which a movement-dependent motor voltage is produced and applied to a braking circuit, wherein the braking circuit has at least one switching element executed as a field effect transistor (FET), over which the motor terminals can be short-circuited. In the braking circuit, a drain-source section of the field effect transistor is disposed, and a voltage between the gate and source of the field effect transistor is set using a potentiometer disposed in parallel connection with the drain-source section of the field effect transistor. A voltage tap of the potentiometer is connected to the gate connection of the field effect transistor. Thus the field effect transistor is operated as a voltage-dependent load resistance for the electric motor, so that the braking force of the braking mechanism depends on the output voltage of the generator operated as an electric motor.

The invention is based on the task of specifying a braking mechanism for a movable door wing and a corresponding door with a braking mechanism of this type, which damps the door wing after its release such that independently of the kinetic energy upon release, bumping of the door leaf in its open position is prevented.

This goal is accomplished by the features of the braking mechanism for a movable door wing according to claim 1 and the features of the door according to claim 11.

Advantageous embodiments and further developments of the invention are specified in the other claims.

The braking mechanism according to the invention for a movable door wing has an electric motor operating as a generator, the at least one drive shaft of which is rotatable by a movement of the door wing and at the terminals of which a movement-dependent output voltage is produced, which is applied to an evaluation and control unit, and a stop spring which damps a manual opening movement of the door wing between a predetermined opening angle and a maximum opening angle with a constant first damping. According to the invention, the evaluation and control unit performs a pulse width modulation of the motor current that cooperates with the output voltage and produces an effective braking sequence, generating a variable second damping of the opening movement of the door wing, so that the door wing, when released, stops when the maximum opening angle is reached.

In addition, a door with a movable door wing and a braking mechanism of this type is suggested, which damps the opening movement of the door wing.

Embodiments of the braking mechanism according to the invention execute an "intelligent opening damping" of the movable door wing with the goal that the door wing will be damped after release in precisely such a manner that the door wing, independent of the kinetic energy on release will not bump in the open position. This means that the evaluation and control unit, by means of pulse width modulation, regulates a shunting of the connection terminals of the electric motor acting as a generator and thus regulates the variable second damping of the opening movement of the movable door wing in such a manner that the door wing stops in its open position without bumping. Depending on the kinetic energy in the door wing, the second variable damping begins sooner or later, in order to adjust the braking force sequence optimally to the current kinetic energy in the door wing and to the ambient conditions, for example temperature and/or friction conditions and/or wind conditions etc. The variable second damping of the braking mechanism is preferably regulated over a damping characteristic curve in such a manner that the door wing comes to a standstill exactly in the open position.

Known methods of opening damping operate without regulation of damping. The intelligent opening damping not only prevents bumping but also reaches the open position even with ambient conditions that vary over time.

In a preferred embodiment of the braking mechanism according to the invention for a movable door wing, at least one sensor can capture at least one physical parameter that represents the opening movement of the door wing. For example, the at least one sensor may output at least one measured value for determining an opening movement to the evaluation and control unit. Additionally or alternatively, the at least one sensor can output a measured variable for determining a current opening angle of the door wing to the evaluation and control unit.

In a further advantageous embodiment of the braking mechanism according to the invention, the evaluation and control unit, based on a moment of inertia of the door wing and the at least one physical parameter detected, can calculate a current kinetic energy of the door wing. Furthermore the evaluation and control unit can calculate a sequence for the second damping based on the kinetic energy of the door wing and generate the corresponding braking force sequence. Alternatively the evaluation and control unit, depending on the calculated kinetic energy of the door wing, can select one of several characteristic curves for the course of the variable second damping of the opening movement of the door wing that have been stored in a memory.

In an additional advantageous embodiment of the braking mechanism according to the invention, the evaluation and control unit regulates the sequence for the variable second damping based on a setpoint value curve in such a manner that the door wing stops at the desired opening angle. Advantageously the actual velocity along this setpoint value curve is regulated such that the door wing stops at the desired opening angle.

In a further advantageous embodiment of the braking mechanism according to the invention, the maximum opening angle and/or the moment of inertia of the door wing can be prespecified using parameters or determined a startup.

The electric motor, operated as a generator, for example can be executed as a brush motor or a brushless direct current motor.

In the following, an exemplified embodiment of the invention will be explained in further detail based on graphical representations.

Figure 2:
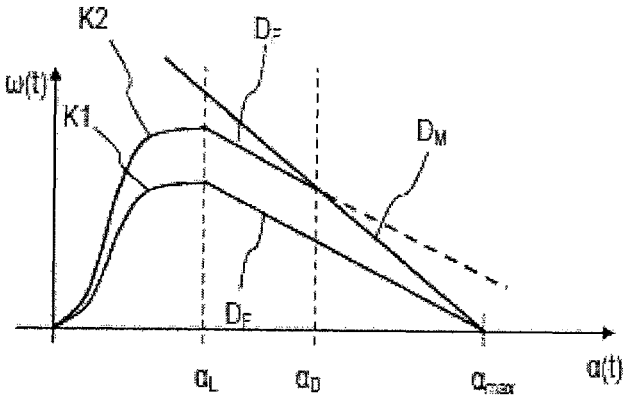
Figure 3:
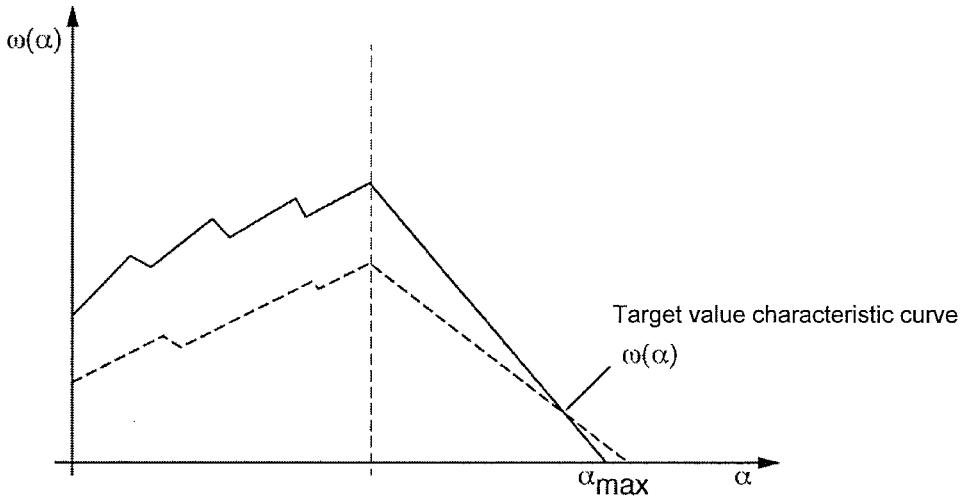
Figure 4:
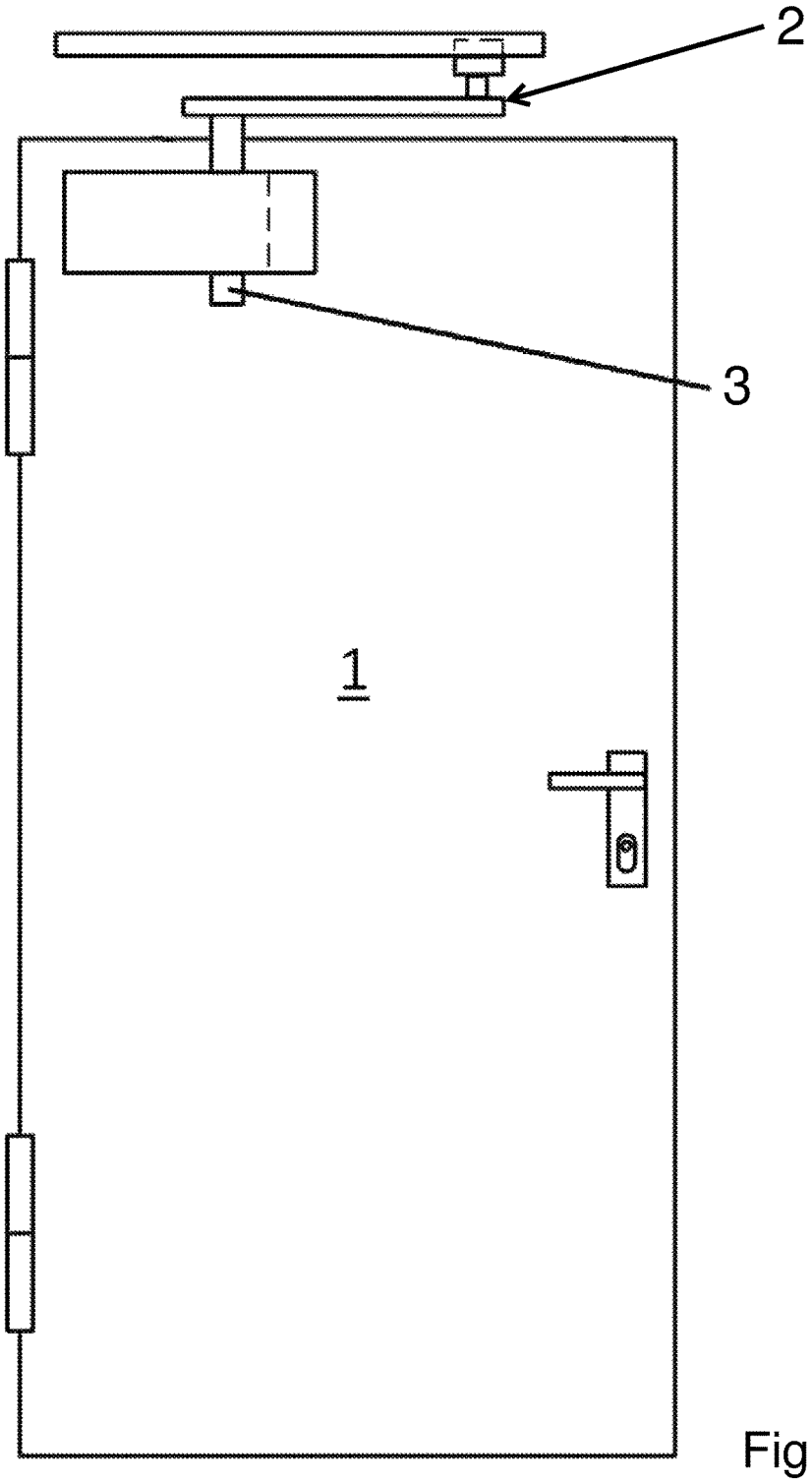

These show the following:

FIG. 1 a schematic block diagram of an exemplified embodiment of a braking mechanism as disclosed herein, FIG. 2 a schematic diagram of an opening movement sequence of a movable door wing, the opening movement of which is dampened by the braking mechanism as disclosed herein, FIG. 3 a schematic diagram for regulating the velocity along a set point value curve, and FIG. 4 a door showing the movable door wing and braking mechanism of FIGS. 1-3 as disclosed herein.

As is apparent from the figures, the illustrated exemplified embodiment of a braking mechanism 10 according to the invention for a movable door wing 1 has an electric motor 14 operating as a generator, the at least one drive shaft of which, not shown in detail, can be rotated by a movement of the door wing 1, and at the terminals thereof, a movement-dependent output voltage is produced, which is applied to an evaluation and control unit 20, and a stop spring 12 which damps a manual opening movement of the door wing 1 between a predetermined opening angle $\alpha_L$ and a maximum opening angle $\alpha_{max}$ with a constant first damping $D_F$. According to the invention, the evaluation and control unit 20 performs a pulse width modulation PWM of the motor current that cooperates with the output voltage and produces an effective braking sequence, generating a variable second damping $D_M$ of the opening movement of the door wing 1, so that the door wing 1, when released, stops when the maximum opening angle $\alpha_{max}$ is reached.

As is further apparent from the figures, at least one sensor 16 captures at least one physical parameter $\alpha(t)$, $\omega(t)$, that represents the opening movement of the door wing 1. In the exemplified embodiment shown, a first sensor 16 outputs a measured value for determining an opening velocity $\omega(t)$ of the door wing 1 to the evaluation and control unit 20, and a second sensor 16 outputs a measured value for determining a current opening angle $\alpha(t)$ of the door wing 1 to the evaluation and control unit 20.

In the exemplified embodiment of the braking mechanism 10 according to the invention for a movable door wing 1, beyond the predetermined opening angle $\alpha_L$ the stop spring 12 damps the opening movement of the door wing 1 with a constant first damping $D_F$, which is predetermined by the characteristics or the spring constant C of the stop spring 12. Beyond a calculated opening angle $\alpha_D$, the evaluation and control unit 20 over a regulator 22 regulates a shunting by pulse width modulation between the terminals of the electric motor 14 operated as a generator and thus regulates the variable second damping $D_M$, so that the door wing 1, stops in the open position, i.e., when the maximum opening angle $\alpha$max is reached. Depending on the kinetic energy $E_{kin}$ in the door wing 1, the calculated opening angle $\alpha_D$ and the variable second damping $D_M$ begins earlier or later, so that the opening movement of the door wing 1 is finished when the open position of the maximum opening angle $\alpha_{max}$ is reached. In the exemplified embodiment, the electric motor 14, operated as a generator, is executed as a brushless direct current motor. Alternatively, the electric motor 14, operated as a generator, for example can also be executed as a brush motor.

In summary, the sequence of the opening movement of the door wing 1 described in the following results. The door or the door wing 1 is manually opened, accelerated in the direction of opening during this process, and then released. Because of its moment of inertia J the door wing 1, after release, will move at least a small distance farther in the direction of the open position, which corresponds to the maximum opening angle $\alpha_D$, and upon reaching the prespecified opening angle $\alpha_L$ against the force of the stop spring 12 If the kinetic energy $E_{kin}$ in the door wing 1 is too low to stretch the stop spring 12 far enough for the door wing 1 to reach its open position, the evaluation and control unit 20 will not intervene in the movement sequence. The evaluation and control unit 20 will exhibit this behavior until the kinetic energy $E_{kin}$ in the door wing 1 is sufficient to stretch the spring just enough so that the door wing 1 stops in the open position. This state is represented by a first characteristic curve K1 in FIG. 2. This means that the first damping $D_F$, which is produced by the stop spring 12, is sufficient to prevent bumping of the door wing 1 in the open position.

A second characteristic curve K2 in FIG. 2 shows a condition in which the kinetic energy $E_{kin}$ in the door wing is too large to be braked by the first damping $D_F$ generated by the stop spring 12 sufficient to stretch the spring just enough so that the door wing 1 does not bump in the open position. Therefore the evaluation and control unit 20 intervenes over the variable second damping $D_M$ and damps the opening movement of the door wing 1 after its release exactly such that the door wing 1 stops in the open position without bumping, regardless of the kinetic energy $E_{kin}$ of the door wing 1 when it is released.

To perform the regulation, in the exemplified embodiment shown the maximum opening angle $\alpha_{max}$ and the moment of inertia J of the door wing 1 are prespecified by parameters. Alternatively, the maximum opening angle $\alpha_{max}$ can be determined by learning. For example, the maximum opening angle $\alpha_{(t)}$ ever measured can be defined as the open position (max $\{a_{(t)}\}=a_{max}$) or the maximum opening angle $\alpha_{max}$ can be determined upon start-up. In addition, the evaluation and control unit 20 can calculate the moment of inertia J of the door wing 1 upon startup from the follow-on angle without damping.

Based on the moment of inertia J of the door wing 1 and the at least one physical parameter $\alpha(t)$, $\omega(t)$ detected, the evaluation and control unit 20 calculates a current kinetic energy $E_{kin}$ of the door wing 1. In the exemplified embodiment presented, a memory unit 24 is provided in which several characteristic curves for the course of the variable second damping $D_M$ of the opening movement of the door wing 1 are stored. Depending on the calculated kinetic energy $E_{kin}$ of the door wing 1, the evaluation and control unit 20 selects one of the stored characteristic curves for the course of the variable second damping $D_M$ of the opening movement of the door wing 1 and generates the corresponding course of the braking force by pulse width modulation PWM of the motor current. Alternatively the evaluation and control unit 20 can calculate a sequence for the variable second damping $D_M$ based on the kinetic energy $E_{kin}$ of the door wing 1 and generate the corresponding braking force sequence through pulse width modulation PWM of the motor current.

The braking device 10 damps the opening movement of the door wing 1 in such a manner that in the open position, equation (1) and $\omega_{(\alpha max)}=0$ apply:

$$E_{kin(\alpha_{max})} = \frac{1}{2} J \omega^2_{(\alpha_{max})} = 0 \tag{1}$$

In order for the door wing 1 to reach the open position, the kinetic energy $E_{kin}$ at every angle $\alpha(t)$ corresponds to the potential energy required for stretching the stop spring 12 up to the open position, as is apparent from equation (2).

$$E_{kin(\alpha(t))} = \frac{1}{2} J \omega^2_{(\alpha(t))} = \frac{1}{2} C(\alpha^2_{max} - \alpha^2_{(t)}) \tag{2}$$

Equation (2) provides the framework for selecting a damping characteristic curve for the variable second damping, $D_M$.

Exemplified embodiments of the braking mechanism 10 according to the invention for a movable door wing 1 allow, depending on the kinetic energy $E_{kin}$ in the door wing 1, constant damping of the opening movement of the door wing 1 after release up to the open position or constant damping beyond a parameterizable opening angle min this process, the damping can be increased as the open position comes closer.

Exemplified embodiments of the braking mechanism according to the invention for a movable door wing 1 have the advantage that the door wing reaches the open position when the kinetic energy is sufficient. In addition, the door wing does not bump into the open position, but the open position is approached gently, wherein the influence of friction and/or wind as well as the effect of the temperature of the electric motor can be compensated.

LIST OF SYMBOLS

1 Door wing
10 Braking device
12 Stop spring
14 Electric motor
16 Sensor
20 Evaluation and control unit
22 Regulator
24 Memory
K1, K2 Movement characteristic curve
$D_F$, $D_M$ Damping characteristic curve
J Moment of inertia
$\omega(t)$ Opening characteristic curve
$\omega_S(t)$ Target value characteristic curve
$\alpha(t)$ Opening angle
$\alpha_L$ Prespecified opening angle
$\alpha_D$ Calculated opening angle
$\alpha_{max}$ maximum opening angle

The invention claimed is:

1. A braking mechanism (10) for a movable door wing (1) with an electric motor (14) having terminals and operating as a generator, and at least one drive shaft, the at least one drive shaft of which can be rotated by a movement of the door wing (1), and at the terminals thereof, a movement-dependent output voltage and a current is produced, which is applied to an evaluation and control unit (20), and a stop spring (12) which damps a manual opening movement of the door wing (1) between a predetermined opening angle ($\alpha_L$) and a maximum opening angle ($\alpha_{max}$) with a constant first damping ($D_F$), wherein the evaluation and control unit (20) performs a pulse width modulation (PWM) of the motor current that cooperates with the output voltage and produces an effective braking sequence, generating a variable second damping ($D_M$) of the opening movement of the door wing (1), so that the door wing (1), when released, stops when the maximum opening angle ($\alpha_{max}$) is reached.

2. The braking mechanism according to claim 1, wherein at least one sensor (16) captures at least one physical parameter ($\alpha(t)$, $\omega(t)$) that represents the opening movement of the door wing (1).

3. The braking mechanism according to claim 2, wherein the at least one sensor (16) may output at least one measured value for determining an opening velocity ($\omega(t)$) of the door wing (1) to the evaluation and control unit (20).

4. The braking mechanism according to claim 2, wherein the at least one sensor (16) outputs a measured value for determining a current opening angle ($\alpha(t)$) of the door wing (1) to the evaluation and control unit (20).

5. The braking mechanism according to claim 2, wherein based on a moment of inertia (J) of the door wing (1) and the at least one physical parameter ($\alpha(t)$, $\omega(t)$) detected, the evaluation and control unit (20) calculates a current kinetic energy ($E_{kin}$) of the door wing (1).

6. The braking mechanism according to claim 5, wherein the evaluation and control unit (20) calculates a sequence for the variable second damping ($D_M$) based on the current kinetic energy ($E_{kin}$) of the door wing (1) and generates a corresponding braking force sequence.

7. The braking mechanism according to claim 5, wherein the evaluation and control unit (20), depending on the current kinetic energy ($E_{kin}$) of the door wing (1), selects one of several characteristic curves for the variable second damping ($D_M$) of the opening movement of the door wing (1) that have been stored in a memory (24).

8. The braking mechanism according to claim 1, wherein the evaluation and control unit (20) regulates the variable second damping ($D_M$) based on a target value characteristic curve ($\omega_S(t)$) such that the door wing (1) stops at the desired opening angle ($\alpha_{max}$).

9. The braking mechanism according to claim 1, wherein the maximum opening angle ($\alpha_{max}$) or a moment of inertia (J) of the door wing (1) can be prespecified using parameters or determined at startup.

10. The braking mechanism according to claim 1, wherein the electric motor (14) is executed as a brush motor or a brushless direct current motor.

11. A door with a movable door wing (1) having a braking mechanism (10), the braking mechanism including an electric motor (14) having terminals and operating as a generator, and at least one drive shaft which is rotated by a movement of the door wing (1), wherein at the terminals of the electric motor (14), a movement-dependent output voltage and a current is produced, which is applied to an evaluation and control unit (20), and the braking mechanism (10) including a stop spring (12) which damps an opening movement of the door and door wing (1) between a predetermined opening angle ($\alpha_L$) and a maximum opening angle ($\alpha_{max}$) with a constant first damping ($D_F$), wherein the evaluation and control unit (20) performs a pulse width modulation (PWM) of the motor current that cooperates with the output voltage and produces an effective braking sequence, generating a variable second damping ($D_M$) of the opening movement of the door wing (1), so that the door wing (1), when released, stops when the maximum opening angle ($\alpha_{max}$) is reached.

* * * * *